United States Patent [19]

Gref

[11] 4,344,552

[45] Aug. 17, 1982

[54] INDEPENDENT DRIVE FOR A ROLLER CAVITY SUCTION APPARATUS

[75] Inventor: Hans Gref, Cologne, Fed. Rep. of Germany

[73] Assignee: Agfa-Gevaert AG, Leverkusen, Fed. Rep. of Germany

[21] Appl. No.: 141,136

[22] Filed: Apr. 16, 1980

[30] Foreign Application Priority Data

Apr. 19, 1979 [DE] Fed. Rep. of Germany ..... 2915804

[51] Int. Cl.[3] ..... B65H 17/28; B65H 23/22

[52] U.S. Cl. ..... 226/95; 226/42

[58] Field of Search ..... 226/95, 24, 42, 88

[56] References Cited

U.S. PATENT DOCUMENTS

| | | | |
|---|---|---|---|
| 2,753,181 | 7/1956 | Anander | 226/95 |
| 2,816,757 | 12/1957 | Burkhart | 226/95 |
| 3,093,283 | 6/1963 | Hodges | 226/95 |
| 3,162,345 | 12/1964 | Gallard | 226/95 |

*Primary Examiner*—Edward J. McCarthy

*Attorney, Agent, or Firm*—Connolly and Hutz

[57] ABSTRACT

The invention relates to the driving of rollers of roller cavity suction apparatus for conveying or braking material webs whereby the motors for driving at least one of the rollers receive the power output from the pressure drop between the front and reverse side of the web.

3 Claims, 5 Drawing Figures

INDEPENDENT DRIVE FOR A ROLLER CAVITY SUCTION APPARATUS

The present invention relates to a device for driving the rollers of a roller cavity suction apparatus for conveying or braking of material webs, e.g. of photographic film webs or paper webs. In this, the web lies on at least two rollers which are positioned near to each other, and there is a pressure difference in the region of the rollers between the front and the reverse sides of the web, which presses the web against the rollers. By this means a creased web shape having the form of a corrugated sheet is produced. In the limiting case of a cavity suction apparatus with only two rollers, the web has only one bead. The radius of curvature of the bead in the web or the web kink depends on the pressure difference and the web tension.

Cavity suction apparatus are preferably used in drying stretches in which the layer or layers which have been freshly applied to a bed cannot touch the surface of the guide rollers. Independently from guiding the web through the dryer, the creased web shape ensures that for each roller, the angle of contact is sufficiently large for a good web run. Thus cavity suction apparatus is suitable to be installed in the most diverse types of construction for web guidance in each case.

Very level cavity suction apparatus are known in which the roller axes lie on a plane and convey the web in a vertically ascending or descending manner or horizontally carried or suspended. If the roller axes lie on the surface of a cylinder, then these curved cavity suction apparatus are for diverting the web through, for example, 90° or 180°, without the wetted surface of the web coming into contact with the rollers. The cavity suction apparatus is also suitable for three dimensional web guidance in which the roller axes are no longer parallel.

In German Auslegeschrift No. 19 62 089, a drying stretch with a meandering web guidance is described in which level roller cavity suction apparatus are used for ascending and descending conveyance and curved cavity suction apparatus are used for diverting the web at the top ends of the vertical bends.

German Patent Specification No. 15 74 295 describes a use of the roller cavity suction apparatus for three dimensional web guidance.

The two-roller cavity suction apparatus described in German Patent Specification No. 15 97 656 achieved great technical importance for long drying stretches in which conveyance is in a horizontal and straight manner. In these drying stretches, the web is conveyed in a first direction while laid out and on the return journey, while suspended from cavity suction apparatus.

The construction of roller cavity suction apparatus is the same for all types. The cavity suction apparatus consist of at least two supported rollers which are freely movable, which has on the back a box which is under low pressure, the box sealing the rollers as extensively as possible against normal atmospheric pressure. The web is conveyed over the front of the rollers and is pressed by the normal atmospheric pressure against the rollers, behind which the pressure is low. Thus, web pressure against the rollers is increased and a greater embracing of the rollers due to the sucking in of the web.

Furthermore it is also known to use the roller.cavity suction apparatus as a driving element. For this, an electro-motor can be used with a mechanism in which the supplied torgue is distributed via belt drives, cog wheel mechanisms, or the like to the independent rollers of the roller cavity suction apparatus. The resulting rotational coupling of the independent rollers has a great disadvantage for the conveying of webs which are sensitive to scratches, e.g., of photographic films, in that the roller side surface of the web is damaged when switching on, changing the low pressure or changing the web tension, because the radius of curvature of the continuous loop cannot be adjusted freely but only by the simultaneous relative movement between the surface of the rollers and the surface of the belt in accordance with the pressure difference at the time and the web tension.

A rotational decoupling of the independent rollers could be achieved if a sliding clutch was applied to each roller. The expense of construction would however be considerable since the independent couplers would have to react in a very sensitive way and they would require constant maintenance. Naturally it is also possible for the drive of each independent roller to use a specific small electro-motor. This sort of solution would apply for example if one was considering providing a large volume dryer with two roller cavity suction apparatus for avoiding the tension in the web building up from one roller to another, with a large number of electrical independent roller drives (e.g. for both of the drying installations given in the above mentioned documents).

The expenditure would however be considerable, especially for the wide installation of the alteration and the supply of energy.

The invention is based on the problem of finding an independent drive which is as simple as possible and does not require a special installation for the supply of energy and necessitates a minimum of maintenance.

According to the invention, this problem is solved in that motors are provided for driving at least one of the rollers whose power output is brought about by the pressure drop between the front and reverse side of the web.

In a preferred embodiment, the driving motor is formed by a turbine and according to a particularly practical embodiment, the turbine runner is arranged firmly in axial shank of the roller of the roller cavity suction apparatus.

Surprisingly, it is revealed that also for low pressure differences, a tractive force can be transmitted to the web which is substantially greater than the brake force which results from the frictional resistance of the roller bearing and the milling resistance of the web.

The use of atmospheric turbine drive on the already mentioned long drying stretches of modern coating machines with two roller cavity suction apparatus is of great practical importance, in the form in which they are described in the above mentioned German Patent Specification and German Auslegeschrift, when it proves to be necessary to compensate for the web path resistance formed by intermediate drives in such stretches. Such intermediate drives can be provided on each and every two roller cavity suction apparatus by arranging one or more atmospheric turbines in a simple manner. Since it does not involve too great an expense to provide a greater number of intermediate drives, there exists a simple possibility for keeping the build up of web tension very low from one drive to another. In particular the acceleration of the rollers is made easier at the starting up of the machine. In an extreme case, in each roller cavity suction apparatus each roller can be provided with an atmospheric drive.

The invention is described in more detail in a following embodiment and in an Example.

Figure 1:
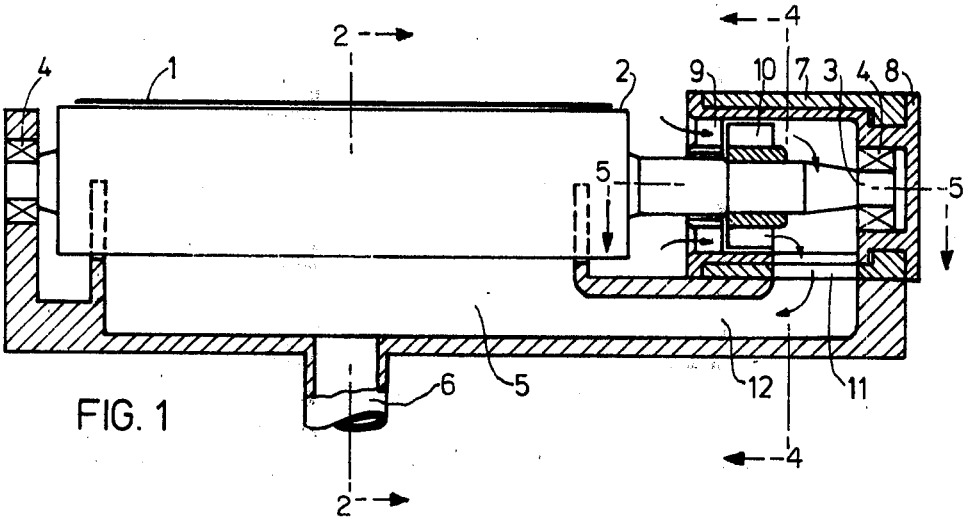
FIG. 1 shows a longitudinal side elevational view partially in cross section of a two roller cavity suction apparatus with a drive taken through the axis of one of the two rollers.
Figure 2:
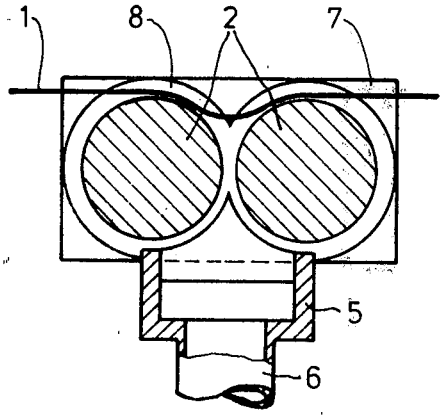
FIG. 2 shows an end elevational view in cross section of a two roller cavity suction apparatus, taken through FIG. 1 along line 2—2.

According to FIGS. 1 and 2, a material web 1, for example, a film coated with photographic emulsion, runs over rollers 2 which together with a suction box 5 and a suction tube 6 connected to a ventilator which is not shown, form the two roller cavity suction apparatus. The rollers are kept as usual in ball bearings 4 as shown on the left in FIG. 1. On the right, between the bearings 4 and the rollers 2, a turbine drive 9, 10 is arranged for each roller, the drive being powered by the air pressure drop between the exterior and the interior of the suction box 5. The direction of the air flow is indicated by arrows.

Both the turbines are arranged in a common casing 7. The drive assembly consists of the casing 7 which is screwed onto the cavity suction box 5, two linings 8, in which the ball bearings 4 are placed, vane rings 9 firmly connected with the linings and turbine bladings 10 which sit on roll pins 3. The casing 7 and the linings 8 are provided with a passage 11, through which the air flowing through the vane ring 9 and the turbine blading 10 flows away via a connecting channel 12 into the hollow suction box 5.

Figure 3:
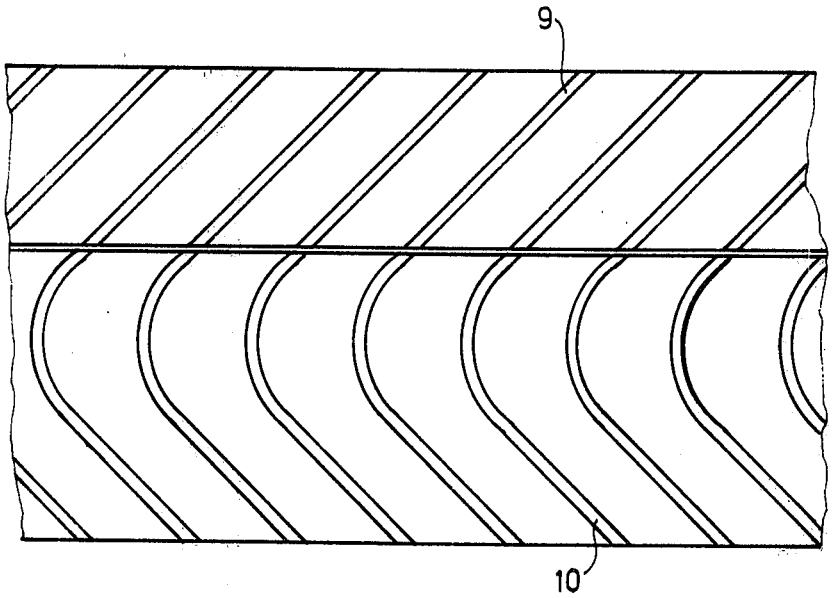
FIG. 3 shows a schematic top plan view section through the unwound control surface blading and turbine blading.

The shape of the guide blades 9 and of the turbine blades 10 is shown in plan in FIG. 3. Air passes through the stationary guide blades 9 which are directed toward the turbine blades 10, is diverted by these, thereby driving the roller 2.

Figure 4:
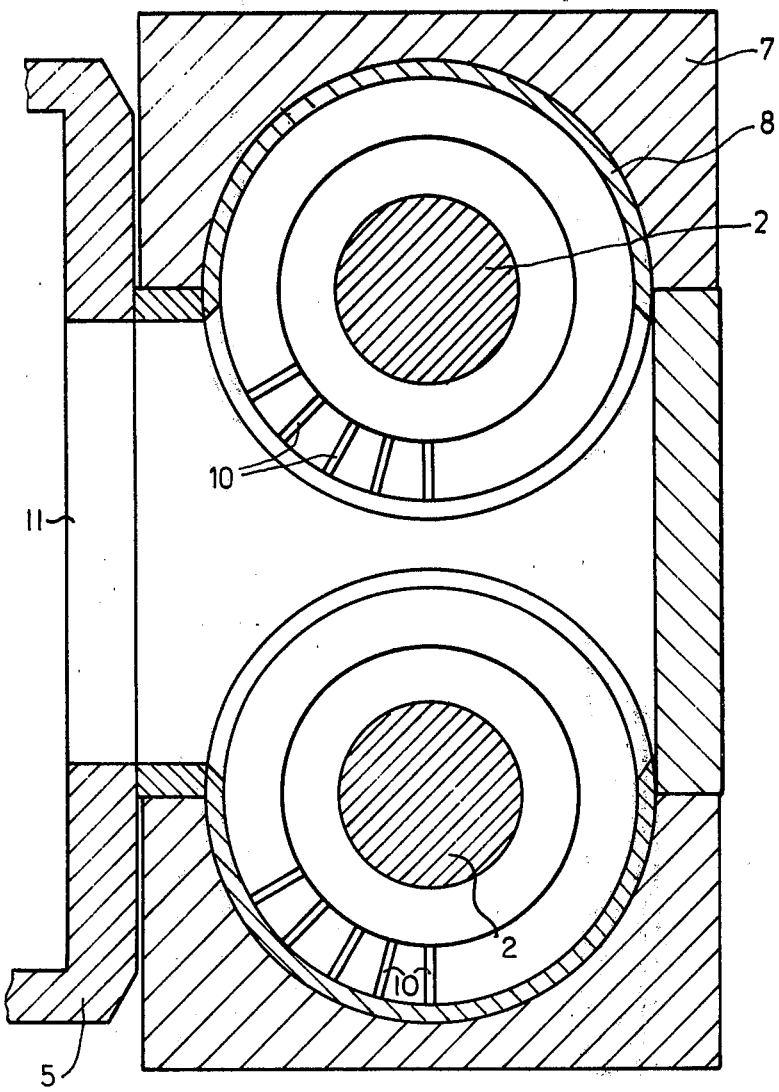
FIG. 4 shows an end elevational view of the turbine blading in vertical section taken through the casing of FIG. 1 along the line 4—4.

In FIG. 4, an end view of the turbine blades 10 is shown in section through the casing 7. The air which has been sucked in now leaves the region of the turbine blades 10 and passes via the passage 11 through lining 8 and casing 7 and the connecting channel 12 (FIG. 1) into the suction box 5.

Figure 5:
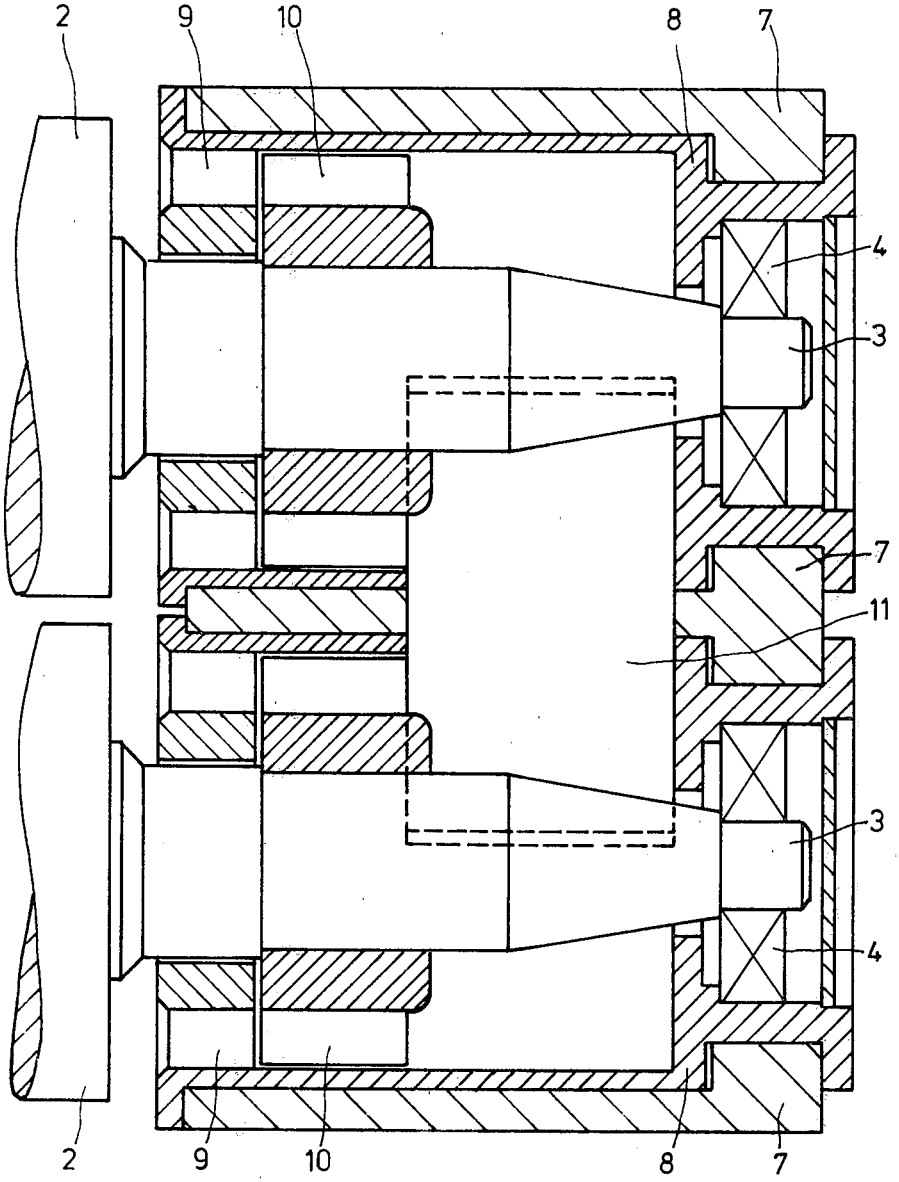
FIG. 5 shows a top view of the set up of a two roller cavity suction apparatus with a turbine drive for the rollers in horizontal section taken through the casing of FIG. 1 along line 5—5.

FIG. 5 shows a top view of the construction of a two roller cavity suction apparatus having a turbine drive 9,10, wherein the casing 7 has been cut in the plane of the roller axis.

Experiments were carried out with a two roller cavity suction apparatus in which both rollers were driven on one side, according to FIGS. 1 to 5. The two roller cavity suction apparatus which was used had the following dimensions:

Roller diameter: 78 mm
Turbine wheel blading blade number: 24
Exterior blade diameter: 70 mm
Interior blade diameter: 50 mm With a low pressure of 10 millibar in the suction box 5 and an air flow of 0.0264 $m^3$/sec per turbine 9, 10, there resulted a torgue of 0.035 Nm per roller. Altogether, the resulting web tension amounted to about 2.8 times the bearing friction resistance and the milling resistance of the two roller cavity suction apparatus at a web velocity of 1 m/sec.

Naturally, the construction according to the invention is not only used for driving, but can also be used for braking the web.

Also the drive of a roller cavity suction apparatus can be such that a roller is driven on one side or also on both sides. With a two sided drive, the driving of roller 2 can be controlled by simple flaps (not shown) which are installed in the connecting channels 12 and by a corresponding arrangement of the turbines so that transport in the run direction of the web 1 or braking of web 1 may be obtained at will.

The invention is not limited to a two roller cavity suction apparatus, but includes multi-roller cavity suction apparatus in which the drive of one or more rollers is on one side or on both sides by means of turbines.

1. Material web
2. Rollers
3. Roll pins
4. Roller bearings
5. Suction box
6. Suction tubulure
7. Casing
8. Lining
9. Guide blade
10. Turbine blade
11. Passage through lining and casing
12. Connecting channel.

I claim:

1. A device for driving rollers of roller cavity suction apparatus for conveying or braking material webs of, for example, photographic film webs or paper webs, wherein the web lies on at least two rollers with a front side in contact with the rollers and a pressure difference exists in the region of the rollers between the front and the reverse side of the web, characterized in that motors are provided for driving at least one of the rollers, the power output of the motors is brought about by the pressure drop between the front and reverse side of the web.

2. A device for driving roller cavity suction apparatus according to claim 1, characterised in that the motor has the form of a turbine.

3. A device for driving roller cavity suction apparatus according to claim 1 characterized in that the turbine drive is positioned firmly on at least one of the axial shanks of the rollers of the roller cavity suction apparatus.

* * * * *